US008795055B2

(12) United States Patent
Vancura

(10) Patent No.: US 8,795,055 B2
(45) Date of Patent: Aug. 5, 2014

(54) SLOT-TYPE GAME WITH NUDGE AND BONUS GAME FEATURES

(76) Inventor: Olaf Vancura, Las Vegas, NV (US)

( * ) Notice: Subject to any disclaimer, the term of this patent is extended or adjusted under 35 U.S.C. 154(b) by 0 days.

(21) Appl. No.: 13/225,694

(22) Filed: Sep. 6, 2011

(65) Prior Publication Data

US 2012/0064961 A1 Mar. 15, 2012

Related U.S. Application Data

(60) Provisional application No. 61/380,405, filed on Sep. 7, 2010.

(51) Int. Cl.
*G07F 17/32* (2006.01)
*G07F 17/34* (2006.01)

(52) U.S. Cl.
CPC ..... *G07F 17/3265* (2013.01); *G07F 17/326* (2013.01); *G07F 17/34* (2013.01)
USPC ..... 463/20; 463/16; 463/21; 463/25

(58) Field of Classification Search
CPC ... G07F 17/32; G07F 17/326; G07F 17/3265; G07F 17/34
USPC ..... 463/16–21, 25
See application file for complete search history.

(56) References Cited

U.S. PATENT DOCUMENTS

| | | | |
|---|---|---|---|
| 426,546 | A | 4/1890 | Reed |
| 524,475 | A | 8/1894 | Wheeland |
| 1,181,027 | A | 4/1916 | Mannhardt |
| 1,520,345 | A | 12/1924 | Hamilton |
| 1,947,772 | A | 2/1934 | Harris |
| 2,192,622 | A | 3/1940 | Radtke |
| 2,614,840 | A | 10/1952 | Monkres |
| 2,732,210 | A | 1/1956 | Heide |
| 3,383,111 | A | 5/1968 | Lucas |
| 3,531,114 | A | 9/1970 | Parks et al. |
| 3,797,828 | A | 3/1974 | Ishikawa et al. |
| 3,807,736 | A | 4/1974 | Goldfarb et al. |
| 3,825,265 | A | 7/1974 | Pitkanen et al. |
| 3,897,951 | A | 8/1975 | Morrison et al. |
| 4,055,342 | A | 10/1977 | Matsumoto |
| 4,055,344 | A | 10/1977 | Soucie |
| 4,508,336 | A | 4/1985 | Yokoi |

(Continued)

FOREIGN PATENT DOCUMENTS

| | | |
|---|---|---|
| DE | 2 359 603 | 6/1974 |
| DE | 3 220 395 | 12/1983 |

(Continued)

*Primary Examiner* — Arthur O Hall
*Assistant Examiner* — Jasson Yoo
(74) *Attorney, Agent, or Firm* — Weide & Miller, Ltd.

(57) ABSTRACT

In a method of playing a game and a gaming device configured to present a game, a plurality of reels display a base set of symbols. The symbols are used to define a base game outcome. In the event a nudge feature is triggered, such as by receipt of trigger symbols in the base game, reels having associated trigger symbols are locked and individual ones of the reels are nudged to new positions, wherein after a particular reel has been nudged, a new game outcome is evaluated. The reels may be nudged sequentially. Other triggers, such as receipt of additional numbers of trigger symbols, may also trigger a primary bonus game, which bonus game may further trigger one or more secondary bonus games.

16 Claims, 2 Drawing Sheets

(56) References Cited

U.S. PATENT DOCUMENTS

| | | | |
|---|---|---|---|
| 4,840,375 | A | 6/1989 | Lawlor et al. |
| 4,871,171 | A | 10/1989 | Rivero |
| 5,004,238 | A | 4/1991 | Okada |
| 5,016,879 | A | 5/1991 | Parker et al. |
| 5,120,060 | A | 6/1992 | Parker et al. |
| 5,131,655 | A | 7/1992 | Ugawa |
| 5,149,095 | A | 9/1992 | Kashimoto et al. |
| 5,241,379 | A | 8/1993 | Tsujita |
| 5,342,049 | A | 8/1994 | Wichinsky et al. |
| 5,393,057 | A | 2/1995 | Marnell, II |
| 5,462,277 | A | 10/1995 | Takemoto |
| 5,494,287 | A | 2/1996 | Manz |
| 5,509,655 | A | 4/1996 | Ugawa |
| 5,516,104 | A | 5/1996 | Takemoto et al. |
| 5,542,669 | A | 8/1996 | Charron et al. |
| 5,603,659 | A | 2/1997 | Okada |
| 5,628,685 | A | 5/1997 | Takemoto et al. |
| 5,636,837 | A | 6/1997 | Takemoto et al. |
| 5,664,775 | A | 9/1997 | Kao |
| 5,707,285 | A | 1/1998 | Place et al. |
| 5,788,230 | A | 8/1998 | Krise et al. |
| 5,845,902 | A | 12/1998 | Takemoto |
| 5,846,902 | A | 12/1998 | Boyles et al. |
| 5,882,261 | A | 3/1999 | Adams |
| 6,047,963 | A | 4/2000 | Pierce et al. |
| 6,139,013 | A | 10/2000 | Pierce et al. |
| 6,203,008 | B1 | 3/2001 | Krise et al. |
| 6,203,009 | B1 | 3/2001 | Sines et al. |
| 6,220,593 | B1 | 4/2001 | Pierce et al. |
| 6,311,976 | B1 | 11/2001 | Yoseloff et al. |
| 6,340,158 | B2 | 1/2002 | Pierce et al. |
| 6,358,146 | B1 | 3/2002 | Adams |
| 6,358,147 | B1 | 3/2002 | Jaffe et al. |
| 6,398,219 | B1 | 6/2002 | Pierce et al. |
| 6,398,644 | B1 | 6/2002 | Perrie et al. |
| 6,419,225 | B2 | 7/2002 | Sines et al. |
| 6,419,226 | B2 | 7/2002 | Krise et al. |
| 6,443,837 | B1 | 9/2002 | Jaffe et al. |
| 6,494,785 | B1 | 12/2002 | Gerrard et al. |
| 6,561,900 | B1 | 5/2003 | Baerlocher et al. |
| 6,565,436 | B1 | 5/2003 | Baerlocher et al. |
| 6,572,472 | B1 | 6/2003 | Glavich |
| 6,582,307 | B2 | 6/2003 | Webb |
| 6,595,854 | B2 | 7/2003 | Hughs-Baird et al. |
| 6,619,659 | B2 | 9/2003 | Krise et al. |
| 6,638,164 | B2 | 10/2003 | Randall et al. |
| 6,645,071 | B2 | 11/2003 | Perrie et al. |
| 6,645,073 | B2 | 11/2003 | Lemay et al. |
| 6,645,074 | B2 | 11/2003 | Thomas et al. |
| 6,648,759 | B2 | 11/2003 | Vancura |
| 6,685,563 | B1 | 2/2004 | Meekins et al. |
| 6,695,699 | B2 | 2/2004 | Beaulieu |
| 6,702,670 | B2 | 3/2004 | Jasper et al. |
| 6,705,944 | B2 | 3/2004 | Luciano |
| 6,725,563 | B1 | 4/2004 | Baerlocher et al. |
| 6,743,094 | B2 | 6/2004 | Johnson |
| 6,746,327 | B2 | 6/2004 | Frohm et al. |
| 6,851,674 | B2 | 2/2005 | Pierce et al. |
| 6,884,173 | B2 | 4/2005 | Gauselmann |
| 6,896,261 | B2 | 5/2005 | Pierce et al. |
| 2001/0009316 | A1 | 7/2001 | Krise et al. |
| 2001/0009317 | A1 | 7/2001 | Sines et al. |
| 2002/0010017 | A1* | 1/2002 | Bennett ..... 463/20 |
| 2002/0119814 | A1* | 8/2002 | Fong et al. ..... 463/13 |
| 2002/0180145 | A1 | 12/2002 | Krise et al. |
| 2002/0180146 | A1 | 12/2002 | Sines et al. |
| 2003/0064797 | A1* | 4/2003 | Jackson et al. ..... 463/25 |
| 2003/0092480 | A1 | 5/2003 | White et al. |
| 2003/0216165 | A1 | 11/2003 | Singer et al. |
| 2004/0048650 | A1* | 3/2004 | Mierau et al. ..... 463/20 |
| 2004/0048652 | A1* | 3/2004 | Ching et al. ..... 463/20 |
| 2004/0219969 | A1 | 11/2004 | Casey et al. |
| 2006/0205469 | A1 | 9/2006 | Schultz et al. |
| 2006/0281525 | A1 | 12/2006 | Borissov |
| 2007/0155474 | A1* | 7/2007 | Gauselmann ..... 463/20 |
| 2008/0108411 | A1* | 5/2008 | Jensen et al. ..... 463/20 |
| 2012/0295688 | A1* | 11/2012 | Watkins et al. ..... 463/20 |

FOREIGN PATENT DOCUMENTS

| | | |
|---|---|---|
| EP | 0 189 256 | 7/1986 |
| EP | 0 671 713 | 9/1995 |
| GB | 2 218 558 | 11/1989 |
| JP | 3-68382 | 3/1991 |
| JP | 4-73076 | 3/1992 |
| JP | 2002325955 | 4/2001 |

* cited by examiner

SLOT-TYPE GAME WITH NUDGE AND BONUS GAME FEATURES

RELATED APPLICATION DATA

This application claims priority to U.S. Provisional Patent Application No. 61/380,405, filed Sep. 7, 2010.

FIELD OF THE INVENTION

The present invention relates to wagering games and gaming machines, and particularly to slot-type games and gaming machines.

BACKGROUND OF THE INVENTION

A continuing need exists in the casino gaming industry to provide new and exciting games to the playing public. A need exists in the casino gaming industry to create methods of playing features or bonus games, as often players are motivated to play slot machines to get into the bonuses themselves. A particular need exists to enhance game play with respect to the base game.

One known bonus feature is the "nudge" feature which is applied to slot type casino games. In its traditional form, the feature causes one or more slot reels to be nudged, i.e. moved upward or downward one or more stops, after the reels' initial stopping position in order to try to give players a better result than would have otherwise been achieved. Such nudging serves to improve a particular spin from one original result to a second final result.

While the traditional nudge feature adds some excitement to slot games, it would be desirable to introduce nudge functionality in new and exciting ways.

SUMMARY OF THE INVENTION

Aspects of the invention comprise games, gaming machines and systems. Preferably, games of the invention are presented as wagering games.

One embodiment of the invention is a game having a base or main game component and a base or main game feature. Preferably, the base game comprises a slot type game in which physical reels or video-represented reels are spun and then stopped to display a base set of symbols. Those symbols are evaluated to determine if a base game winning outcome has occurred.

In one embodiment, if a triggering condition is met, a base game feature is implemented. In a preferred embodiment, this feature comprises a nudge feature. In accordance with the nudge feature, reels are sequentially nudged, wherein the outcome of the game is again evaluated relative to a new set of symbols which are displayed after each individual reel nudge.

In a preferred embodiment, the nudge feature is triggered by the occurrence of two or more triggering symbols in the base game. In one embodiment, each reel which displays a triggering symbol, either as a result of the base game or during the nudge feature, is locked from further movement, whereby only unlocked reels are nudged.

In one embodiment, reels are arranged in horizontally and they are nudged sequentially from left to right and, in a preferred embodiment, back from right to left. Each reel may be configured to display 3 symbols and may be nudged by 3 positions to cause the reel to display up to 3 new symbols.

As an additional feature, a primary bonus game or event may be triggered. In one embodiment, the occurrence of a greater number of triggering symbols also triggers a primary bonus game. The bonus game may offer the opportunity for further awards.

In one embodiment, the bonus game offers players a number of bonus picks. The bonus picks may trigger one or more secondary bonus events and/or direct awards. The secondary bonus events may offer yet further opportunities for awards. The secondary bonus events may comprise pachinko-style games.

The games of the invention may be presented in various manners, including at casino-style wagering devices. Such devices may have a main portion including physical reels or a video display for displaying the main game. The device may also have a top box which houses a bonus game mechanism, such as a mechanical free-motion pachinko-style device.

Further objects, features, and advantages of the present invention over the prior art will become apparent from the detailed description of the drawings which follows, when considered with the attached figures.

DESCRIPTION OF THE DRAWINGS

FIG. 2A illustrates the reel spin outcome of FIG. 2A after a first reel has been nudged in accordance with the invention.

DETAILED DESCRIPTION OF THE INVENTION

Figure 1:
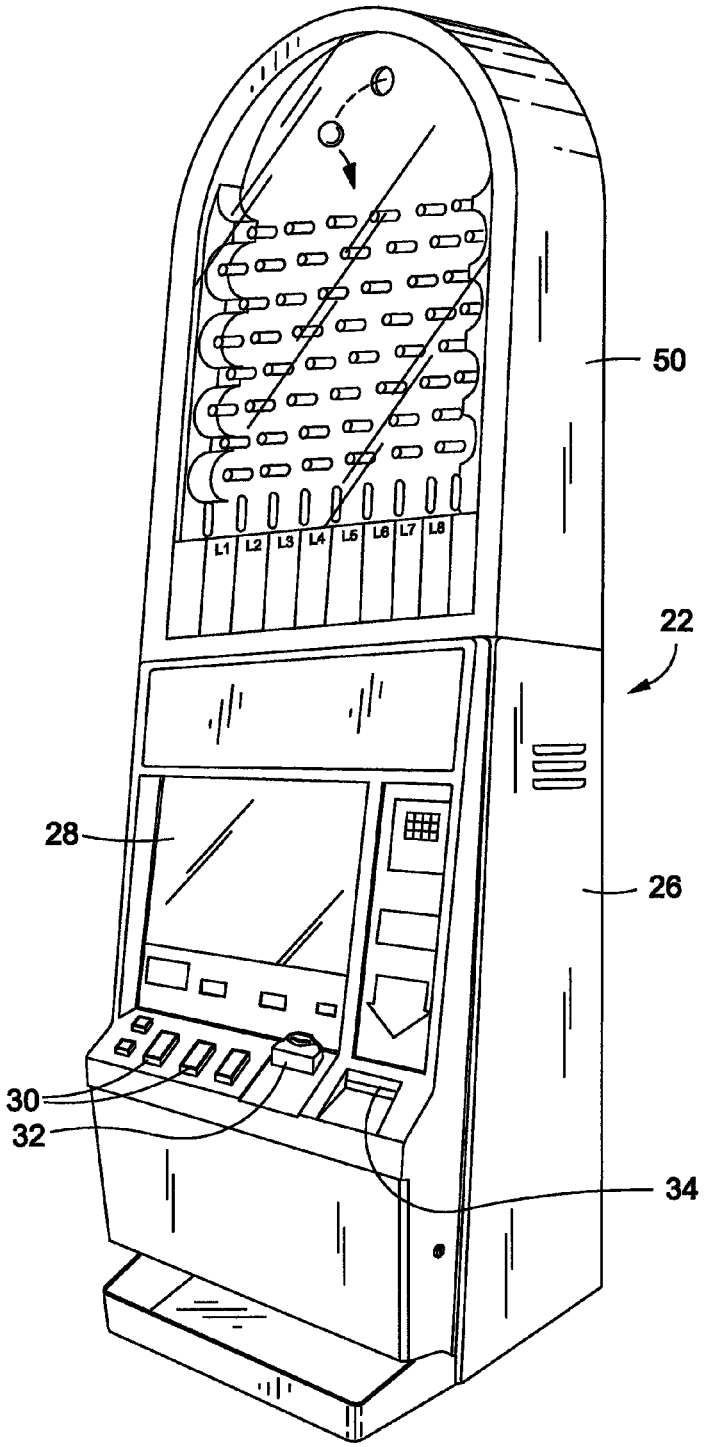
FIG. 1 illustrates an exemplary gaming machine in accordance with the invention, the gaming machine configured to present games of the invention.

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One embodiment of the invention is a slot type game in which a plurality of symbols is displayed by a plurality of physical or virtual (video) reels. In a preferred embodiment, a base game is played using the reels, where the base game has an outcome determined by a set of symbols displayed by the reels.

In a preferred embodiment, the game has a nudge-type base game feature. The nudge feature may be activated or triggered, such as by one or more trigger symbols being displayed by the reels as a result of base game play. In one embodiment, as a result of the nudge feature, individual ones of the reels are nudged or moved, such as by changing the position of each reel to display different symbols. An outcome of the feature may be evaluated after each individual reel is nudged.

In a preferred embodiment, one or more reels may be locked and each unlocked reel is nudged at least once, such as by nudging the unlocked reels in sequence from left to right and then right to left. In a preferred embodiment, each reel may be nudged or moved by three positions.

As another aspect of the invention, the game may include at least one primary bonus game. The primary bonus game may be triggered based upon one or more combinations of symbols in the base game. The primary bonus game may present a player with an opportunity to pick one or more awards.

In a preferred embodiment, the game includes at least one secondary bonus game. In one embodiment, there are two secondary bonus games, each of which may be triggered or activated as a result of play of the primary bonus game.

Additional aspects of the invention, including details and variations of the game and of gaming machines or other devices configured to present such games, will now be described.

Gaming Machine or Device

One aspect of the invention is a gaming machine or device. Preferably, the gaming machine or device is configured to implement the functionality or methodology of the game described herein.

In one embodiment, the gaming device comprises a "slot" machine. As described below, such a machine may include physical spinning reels which display symbols, or one or more video displays which are configured to display video representations of reels which display symbols. The gaming machine may be configured to present a base game via the physical or video simulated reels. The gaming machine may also include a top box, such as used to present one or more bonus games, as described below.

In general, the operating hardware and software necessary to implement a slot machine is well known and is based on one or more communicatively interconnected controllers, processors, or microprocessors (hereinafter collectively referred to as a computer) found within a casino game. Typically, the computer is responsive to wagers placed, payouts made, and various touchscreen or button inputs from the player. These hardware/software configurations in such slot machines are commonly referred to as casino gaming platforms, and casino gaming platforms vary among the various casino game machine manufacturers. Game play logic, choreography, graphics and video sequences and mathematics are coded onto casino gaming machine platforms via software and/or firmware conventionally.

In general, gaming platforms have application outside the casino industry such as in consumer games, military use, etc. An example of one casino gaming machine among many is found in U.S. Pat. No. 6,884,173, which is incorporated herein in its entirety by reference. These gaming machines may be linked conventionally, as through a local controller located at a group of such linked machines. The controller may be capable of receiving input from the slot machines (e.g. coin-in, game state information, game outcome, player input information, triggering information, etc.) as well as provide an output to the slot machines.

The many conventional details for operating a casino game machine are well understood in the industry, including receiving money, accepting wagers, delivering payoffs, operating a casino game machine, etc. In particular, a conventional money reception device(s) such as a bill acceptor, ticket acceptor, or coin slot may be utilized. Too, such conventional wager device(s) such as push-buttons or a touch-screen may be utilized to initiate play. Typically, players may have special player inputs (either physical and/or on-touch-screen) that denote a max bet, spin of the reels, a bonus bet, etc. Likewise a conventional payout device(s) such as a ticket dispenser, bill dispenser, coin dispenser, etc. or any suitable payout device or devices are possible.

The casino base game may communicate over a network card with other casino game machines, computer systems, etc. over a bus. The base games may be linked via controller to form a linked system of slot machines. A computer is functionally interconnected to the money reception device(s), interconnected to the wager device(s), interconnected to the player wager input device(s), interconnected to payout device(s), interconnected to a memory or memories, and interconnected to the top-box bonus game by way of a communications port. The computer thus controls the casino base game and the top box bonus game in the casino gaming machine. In another embodiment, the computer communicates with a top-box controller which controls the top box bonus game. The computer can be any type of one or more processors, microprocessors, controllers, gaming platforms, etc. suitably adapted for the casino game machine as conventionally done in the gaming industry. The computer is also connected to a touch-screen and/or a second screen.

The various methods of base game and bonus game play described herein are conventionally programmed into memory so that the computer can implement the teachings contained herein. Conventionally, the general functional configuration of the gaming device preferably includes a computer memory device(s) for storing program code or other data, main display device, optional secondary display device(s), sound card, speaker(s) and one or more player input devices such as a touch-screen. The computer functionally displays images, symbols and other indicia such as the faces and backs of cards and/or a wide variety of gaming symbols either itself or through communication with a graphics card or a graphics controller. The memory device can include random access memory (RAM) for saving or accessing game data generated or used during a game. The memory device can also include read only memory (ROM) for storing program code which controls the casino gaming machine so that a particular game(s), such as the game(s) of the invention, is loaded and plays in accordance with appropriate game rules and pay tables.

Although the computer and memory device preferably reside on each casino game machine, it is also possible to provide at least some of their functionality at a central location such as a network server for communication to a playing station such as over a network local area network (LAN), wide area network (WAN), Internet connection or other wireless link such as through a network card. With regard to generating random events from a random number generator (e.g., the dealing of cards), it is possible for this to occur locally (e.g., at or within the gaming device or local-area controller) or non-locally (e.g., centrally at a server accessed by wire or wirelessly) or a combination thereof. The random number generator can be a separate component or implemented in software in memory. At least some or all of the above are functionally found in hardware, firmware, and software of conventionally available gaming platforms.

As indicated, the gaming device may be configured with a base slot platform, which may be implemented by one or more video displays and/or physical reels (stepper). For purposes of the present invention, in one embodiment, the casino base game is a multi-reel, multiline video presentation on a conventional touch-screen. Many conventional products of such multi-reel, multi-line casino games are known. A local-area controller (denoted herein as a local controller) may be linked to each of several slot machines. Logically, the local controller communicates with each machine on the link through a slot machine interface board or similar technology, as is well known in the field.

In a preferred embodiment, each individual machine has logic (either through the base game CPU or a top-box controller, collectively denoted herein as a machine computer) which keeps track of the individual machine's status within the community bonus round. So, for a bank of 8 machines, one local controller communicates with 8 machine computers. In another embodiment, a communications bus connects the 8 individual machines to each other, and the machine computers communicate directly with each other, without the need for a central local controller, to carry out the teachings herein.

One embodiment of the invention is a video based game presented by using at least one video display having an associated a touch-screen. The game may utilize a traditional 5×3 (5 reels×3 symbols appearing within the "window") format with multiple pay lines, such as 30 pay lines, and an additional buy-a-pay wager. The player might wager, for example, increments of 1-credit per line, and a buy-a-pay bonus bet equal to ⅔ of the total 30-line bet. A player desiring all functionality is thus required to wager 50 credits, e.g. It is to be expressly understood, however, that any number of reels and any number of pay lines could be utilized in a video or mechanical form to implement the teachings of the invention as presented herein. Similarly, the use of a bonus bet is a design choice and need not be present.

In one embodiment, the gaming machine may include one or more top boxes or secondary features. The gaming machine top box may include one or more additional game display devices, such as one or more video displays, reels, pachinko-style ball or free-motion devices. For example, the gaming machine may include a top box for presenting a mechanical free-motion type device, such as a pachinko-style device. The mechanical pachinko top box has a playfield of deflecting pins and free motion balls that are delivered to the top of the playfield, bounce and ultimately fall through one of ten lanes, is utilized for play of the bonus games. On a display either behind, immediately below the lanes or otherwise associated with the lanes, the lane values and/or lane symbols are displayed. See U.S. Pat. No. 6,896,261 and No. 6,851,674 for pachinko casino games having these features.

In another embodiment, a video representation of the top box bonus game, in the form of a top box display, is utilized. If desired, the video representation can be incorporated into a second-screen of the same base screen, so as to eliminate the additional structure and cost associated with a top box. In addition, multiple bonus games either on the base game or within the top box can be utilized under the teachings of the invention, without the need for additional hardware. Preferably, the casino base game communicates with a top box controller during game play, in order to send instructions and data to the top box, receive results and data back from the top box, and so forth as is conventional in the gaming industry.

One particular configuration of a gaming machine is illustrated in FIG. 1. As illustrated, the gaming machine 22 generally comprises a housing or cabinet 26 for supporting and/or enclosing various components required for operation of the gaming machine. In the embodiment illustrated, the housing 26 includes a door located at a front thereof, the door capable of being moved between an open position which allows access to the interior, and a closed position in which access to the interior is generally prevented. The configuration of the gaming machine 22 may vary. In the embodiment illustrated, the gaming machine 22 has an "upright" configuration. However, the gaming machine 22 could have other configurations, shapes or dimensions (such as being of a "slant"-type or other configuration as is well known to those of skill in the art).

The gaming machine 22 preferably includes at least one display device 28 configured to display game information. As indicated above, the display device 28 may be a mechanical, electro-mechanical or electronic display, such as one or more rotating reels, a video display or the like. When the display device 28 is an electronic video display, it may comprise a cathode ray tube (CRT), high resolution flat panel liquid crystal display (LCD), projection LCD, plasma display, field emission display, digital micro-mirror display (DMD), digital light processing display (DLP), LCD touchscreen, a light emitting display (LED) or other suitable displays now known or later developed, in a variety of resolutions, sizes and formats (e.g. 4:3, widescreen or the like). The display 28 may be capable of projecting or displaying a wide variety of information, including images, symbols and other indicia or information associated with game play, game promotion or other events, such as the slot reel game described herein.

In another embodiment, the gaming machine 22 may include one or more physical reels capable of displaying symbols. In such a configuration, means are provided for rotating the physical reels. In one or more embodiments, the means may comprise a mechanical linkage associated with a spin arm, with movement of the spin arm (a "pull") by a user causing the reels to spin. In such an arrangement, the reels are generally allowed to free-wheel and then stop. In another embodiment, electronically controlled mechanisms are arranged to rotate and stop each reel. Such mechanisms are well known to those of skill in the art. In this arrangement, actuation of the spin arm or depression a spin button causes a controller (not shown) to signal the activation of the spin mechanism associated with one or more of the reels. Preferably, the controller is arranged to either turn off the signal to the device(s) effecting the rotation of each or all of the reels or generates a signal for activating a braking device, whereby the reels are stopped. As is well known, the combinations of reel positions and their odds of hitting are associated with the controller, and the controller is arranged to stop the reels in a position displaying a combination of indicia as determined by the controller based on the combinations and odds. The principal of such an arrangement is described in U.S. Pat. No. 4,448,419 to Telnaes, which is incorporated herein by reference. For example, the base symbols might be associated with spinning reels. Sets of base symbols might be generated by spinning those reels.

As described in more detail below, the gaming machine 22 is preferably configured to present one or more games upon a player making a monetary payment or wager. In this regard, as described in more detail below, the gaming machine 22 includes means for accepting monetary value.

In one embodiment, certain game outcomes may be designated as winning outcomes. Prizes or awards may be provided for winning outcomes, such as monetary payments (or representations thereof, such as prize of credits), or promotional awards as detailed herein. As detailed below, the gaming machine 22 includes means for returning unused monetary funds and/or dispensing winnings to a player.

The gaming machine 22 preferably includes one or more player input devices 30 (such as input buttons, plunger mechanisms, a touch-screen display, joystick, touch-pad or the like). These one or more devices 30 may be utilized by the player to facilitate game play, such as by providing input or instruction to the gaming machine 22. For example, such input devices 30 may be utilized by a player to place a wager, cause the gaming machine 22 to initiate a game (such as spin slot reels), to indicate cards to be held or discarded in a game of video draw poker, to "cash out" of the gaming machine, or to provide various other inputs.

In one preferred embodiment, the gaming machine 22 includes at least one microprocessor or controller for controlling the gaming machine, including receiving player input and sending output signals for controlling the various components of the machine 22 (such as generating game information for display by the display 28). The controller may be arranged to receive information regarding funds provided by a player to the gaming machine, receive input such as a purchase/bet signal when a purchase/bet button is depressed, and receive other inputs from a player. The controller may be arranged to generate information regarding a game, such as generating game information for display by the at least one display 28 (such as information representing images of displayed cards, as disclosed below), for determining winning or losing game outcomes and for displaying information regarding awards for winning game outcomes, among other things.

The controller may be configured to execute machine readable code or "software" or otherwise process information, such as obtained from a remote server. Software or other instructions may be stored on a memory or data storage device. This software may be configured to implement the game described below, such as in the form of one or more steps. The memory may also store other information, such as pay table information, slot reel symbol images or the like. The gaming machine 22 may also include one or more random number generators for generating random numbers, such as for use in selecting slot reel symbols or reel stopping positions or the like for presenting the game in a random fashion.

As indicated above, the gaming machine 22 may be configured to generate and present games in a stand-alone manner or it may be in communication with one or more external devices at one or more times. For example, the gaming machine 22 may be configured as a server based device and obtain game code or game outcome information from a remote game server (in which event the gaming machine controller may receive game information from the server, such as game outcome information, and use that server-generated information to present the game at the gaming machine). In one embodiment, the gaming machines 22 may be game kiosks or interfaces.

As indicated, the gaming machine 22 is configured to present one or more wagering game. Thus, the gaming machines 22 is preferably configured to accept value, such as coins, paper currency or other elements or devices representing value such as monetary funds. For example, as illustrated in FIG. 1, the gaming machine 22 might include a coin acceptor 32 for accepting coins. Of course, associated coin reading/verifying devices and coin storage devices may be associated with the gaming machine 22 if it is configured to accept coins. Likewise, the gaming machine 22 might include a media reader 34. Such a reader may be configured to accept and read/verify paper currency and/or other media such as tickets. Of course, in such event the gaming machine 22 may further be configured with one or more paper currency or ticket storage devices, such as cash boxes, and other paper currency or media handling devices (including transport devices).

The gaming machine 22 might also be configured to read FOBs, magnetic stripe cards or other media having data associated therewith and via which value or funds may be associated with the gaming machine 22.

In one embodiment, the gaming machine 22 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. For example, upon an award or at cash-out, associated funds may be paid to the player by the gaming machine 22, such as by dispensing coins to a coin tray. In another embodiment, funds may be issued by dispensing paper currency. In yet another embodiment, a player may be issued a media, such as a printed ticket, which ticket represents the value which was paid or cashed out of the machine.

It will be appreciated that the gaming machine illustrated in FIG. 1 is only exemplary of one embodiment of a gaming machine. For example, it is possible to for the gaming machine to have various other configurations, including different shapes and styles and having different components than as just described. For example, while the gaming machine or device may be standalone, it may be server-based, server-assisted, linked to other gaming devices, connected to a server, progressive controller (wide-area or local-area), or be handheld and/or wireless. In particular in the case of online wagering, the gaming device may be a computer, mobile phone, or microprocessor-driven device which is programmed to accept wagers, e.g. via downloadable software.

The gaming machine or device 22 may include other features. For example, the gaming machine 22 may include other displays, light, speakers for generating sounds.

In one preferred embodiment, the general electronic configuration of the gaming device is that of a processor/controller, memory device for storing program code or other data, main display device, optional secondary display device, sound card, speakers and one or more input devices. The processor is preferably a microprocessor or a microcontroller capable of displaying images, symbols and other indicia such as the faces and backs of cards. The memory device can include random access memory (RAM) for saving or accessing game data generated or used during a game. The memory device can also include read only memory (ROM) for storing program code which controls the gaming device so that a particular game is loaded and plays in accordance with appropriate game rules and pay tables. Although the processor and memory device preferably reside on each gaming device, it is also possible to provide at least some of their functionality at a central location such as a network server for communication to a playing station such as over a local area network (LAN), wide area network (WAN), Internet connection or other wireless link. With regard to generating random events (e.g., the dealing of cards), it is possible for this to occur locally (e.g., at or within the gaming device) or non-locally (e.g., centrally at a server accessed by wire or wirelessly), or a combination thereof.

Preferably, the gaming machine or device 22 displays slot reels and associated reel symbols. To operate the gaming machine 22 the player is preferably required to insert money (or a ticket, or otherwise provide value). The player may then initiate game play by an input, such as by pressing a Bet Max button, or a Bet One button and then a Deal button. The wagering game described herein then begins.

The player preferably uses the input devices such as Bet One, Bet Max, etc., to input signals to the gaming device. Alternatively or in addition to input buttons, a touch screen may be utilized. In the case of online gaming, a keyboard or mouse may also provide input. In the case of mobile phone gaming, a keyboard or telephone keys may be utilized to provide input.

FIG. 1 also illustrates a configuration of a gaming machine 22 having a free-motion type device associated with a top box 50 thereof, in the manner described above.

Finally, it is understood that the casino games and methods of the invention herein can be implemented in consumer computer systems such as Apple MAC computers and/or over the Internet, via kiosks or other devices.

Slot Base Game

One embodiment of the invention comprises a method of playing and presenting a slot-type game. This slot game may comprise a main or base game (though features of the invention may be implemented as bonus or secondary games or the like).

In one embodiment, the base game is a video-style slot game displaying 5 columns and 3 rows (5×3) of symbols (such as upon the main display of a gaming machine), wherein the player may wager upon up to 30 pay lines in increments of 1-credit per line, and where the game may include a "buy-a-pay" wager. Each column preferably represents a reel, and each row represents a symbol position displayed on the reel. So, a 5×3 format refers to 5 reels with 3 symbols positions displayed on each reel.

The buy-a-pay feature is an arrangement whereby a subset of payoffs must be "bought" in order to be active. Historically used on mechanical slots, for example, a first coin would buy a set of "Cherry" pays, the second a set of "Bar" pays, and the third a set of "7" pays. For example, a player playing one coin and hitting 7-7-7 would not get paid on such a machine. The "buy-a-pay" formats are used on video slots now as well, in order to offer access to payoffs, features or bonus games that otherwise would not take place.

The gaming machine display may be configured to display various icons. A touch screen of the display may be configured to receive input from the player relative to those icons. For example, at the bottom of the screen and moving from left to the rights, the following touch buttons and/or boxes may be displayed: Help/Pays; Denom icon (going to a denomination selection screen if touched); Credit Box; Lines Box; Line Bet Box; Bonus Bet Box; and Win (Paid) Box.

The "Bonus Bet" feature is typically a fraction (e.g., ⅔) of total 30-line bet if wagering upon all 30 lines (50 credits minimum wager). In principle, the Bonus Bet need not be utilized under the teachings herein, might be optional or might be utilized in a different manner. In a preferred embodiment, the Bonus Bet affords the player the opportunity for additional bonus game play and/or additional game feature play on the slot machine. In one embodiment, the base slot machine game may include different types of play symbols and typically includes a wild symbol, different themed symbols and one or more trigger symbols. Any theme or set of names could be used for the symbols including trigger and wild symbols.

In a preferred embodiment, the base game is video format with standard 5×3 reel arrangement. Credit wagering is incremental upon 30 pay lines with a 20 credit incremental buy-a-pay (50 credits minimum wager). All wagers require a bet on maximum pay lines and the buy-a-pay wager, so that the possible wagers are 50, 100, 150, 200, 250 credits. In other embodiments, a 5×4 reel arrangement, or other reel arrangement may be utilized.

Set forth below are representative preferred pay lines with reference to the following configuration of 5 reels each displaying 3 symbol positions as designated below:

| Reel 1 | Reel 2 | Reel 3 | Reel 4 | Reel 5 |
|---|---|---|---|---|
| 1 | 1 | 1 | 1 | 1 |
| 2 | 2 | 2 | 2 | 2 |
| 3 | 3 | 3 | 3 | 3 |

Line 1: 2,2,2,2,2
Line 2: 1,1,1,1,1
Line 3: 3,3,3,3,3
Line 4: 1,2,3,2,1
Line 5: 3,2,1,2,3
Line 6: 1,1,2,3,3
Line 7: 3,3,2,1,1
Line 8: 2,1,2,3,2
Line 9: 2,3,2,1,2
Line 10: 2,1,1,1,2
Line 11: 2,3,3,3,2
Line 12: 1,2,1,2,1
Line 13: 3,2,3,2,3
Line 14: 2,1,2,1,2
Line 15: 2,3,2,3,2
Line 16: 2,2,1,2,2
Line 17: 2,2,3,2,2
Line 18: 1,3,1,3,1
Line 19: 3,1,3,1,3
Line 20: 1,2,2,2,3
Line 21: 1,2,2,2,1
Line 22: 1,1,3,1,1
Line 23: 3,3,1,3,3
Line 24: 2,1,3,1,2
Line 25: 2,3,1,3,2
Line 26: 1,3,2,3,1
Line 27: 3,1,2,1,3
Line 28: 1,3,3,3,1
Line 29: 3,1,1,1,3
Line 30: 1,2,3,3,3

Of course, the game may be played using other numbers of pay line and pay lines comprising other combinations of displayed symbols/positions.

Set forth below is one preferred embodiment of a reel matrix for the base slot game:

| 53 | 91 | 55 | 91 | 56 | |
|---|---|---|---|---|---|
| 1 | 2 | 2 | 2 | 1 | !Wild |
| 3 | 3 | 3 | 5 | 4 | !Symbol 2 |
| 3 | 4 | 3 | 6 | 5 | !Symbol 3 |
| 3 | 6 | 3 | 6 | 3 | !Symbol 4 |
| 4 | 8 | 3 | 6 | 3 | !Symbol 5 |
| 4 | 8 | 4 | 6 | 3 | !Symbol 6 |
| 5 | 11 | 8 | 11 | 6 | !Symbol 7 |
| 7 | 11 | 6 | 11 | 7 | !Symbol 8 |
| 10 | 12 | 5 | 12 | 7 | !Symbol 9 |
| 6 | 12 | 7 | 12 | 8 | !Symbol 10 |
| 6 | 12 | 10 | 12 | 8 | !Symbol 11 |
| 1 | 2 | 1 | 2 | 1 | !Trigger |

Set forth below are preferred embodiments of symbol combinations for each of the reels of the base game (relative to the symbol chart detailed below):

Reel 1: S9 S7 S3 S6 S2 S7 S9 S6 S8 S4 S9 S11 S5 W S8 S7 S5 S6 S8 S9 S7 S5 S8 S4 S11 S10 S9 S3 S11 T S10 S9 S8 S4 S10 S9 S2 S11 S5 S9 S10 S2 S11 S9 S3 S10 S6 S8 S9 S7 S10 S11 S8

Reel 2: S7 S6 S2 S10 S4 S9 S7 W S5 S8 S11 S2 S7 S6 W S10 S8 S7 S6 S11 S10 S3 S9 S5 S10 S9 S5 S11 S4 S7 T S9 T S8 S4 S2 S10 S9 S11 S8 S10 S5 S11 S3 S6 S9 S11 S7 S6 S3 S10 S9 S4 S7 S10 S5 S11 S8 S6 S10 S7 S9 S8 S6 S11 S10 S5 S8 S11 S4 S9 S5 S11 S7 S9 S4 S8 S7 S10 S11 S8 S3 S10 S9 S7 S8 S11 S6 S9 S5 S8

Reel 3: S7 S8 S11 S9 S3 S8 S5 S11 S6 S8 S10 S2 S7 S6 S11 W S7 S9 S5 S10 S11 S6 S7 S8 S5 S9 S4 S7 S10 S11 S4 S7 S6 S11 S8 S10 T S9 S3 S7 S11 W S10 S4 S2 S11 S3 S10 S7 S11 S8 S9 S2 S11 S10

Reel 4: S4 S9 S3 S6 S7 W S11 S3 S9 S6 S10 S5 S8 S11 S2 S9 S8 S7 S9 S11 W S5 S8 S10 S11 S5 S9 S8 S7 S4 S10 S6 S3 S8 T S10 T S11 S2 S10 S9 S11 S4 S2 S9 S7 S3 S6 S7 S9 S6 S10 S5 S11 S8 S7 S9 S6 S11 S5 S8 S10 S5 S7 S11 S4 S10 S7 S3 S11 S10 S3 S8 S2 S10 S9 S11 S2 S7 S8 S4 S9 S10 S11 S7 S8 S4 S9 S10 S7 S8

Reel 5: S9 S5 S7 S10 S3 S6 S8 S2 S11 S7 S10 S6 S8 S11 S5 W S8 S7 S3 S9 S11 S6 S8 T S7 S11 S9 S4 S10 S11 S3 S8 S2 S9 S5 S10 S4 S7 S9 S2 S10 S11 S9 S3 S10 S2 S11 S9 S10 S8 S11 S3 S7 S8 S4 S10

It will be appreciated that other symbol arrangements may be utilized. It will also be appreciated that various symbols may be used such as graphical icons, text, numbers, words, images or other representations of information.

Set forth below is a preferred pay table for a base slot game of the invention wherein the game has a "Having a Ball" free spins secondary bonus game (as described in greater detail below). In this example, all outcomes are determined from left to right starting with leftmost reel and only the highest winner or winning outcome is paid per pay line. In this example, Symbol 1 is Wild and substitutes for Symbols 2-11. Pay 12 is "Any Bar/Jewel" comprised of a mixture of Symbols 4-6.

PAYTABLE

| Symbol | Of a Kind | Pays (x line bet) |
|---|---|---|
| W | 5 | 1,000 |
| | 4 | 200 |
| | 3 | 50 |
| S2 | 5 | 300 |
| | 4 | 100 |
| | 3 | 30 |
| S3 | 5 | 250 |
| | 4 | 75 |
| | 3 | 25 |
| S4 | 5 | 200 |
| | 4 | 40 |
| | 3 | 20 |
| S5 | 5 | 150 |
| | 4 | 30 |
| | 3 | 15 |
| S6 | 5 | 125 |
| | 4 | 20 |
| | 3 | 10 |
| S7 | 5 | 100 |
| | 4 | 20 |
| | 3 | 5 |
| S8 | 5 | 100 |
| | 4 | 20 |
| | 3 | 5 |
| S9 | 5 | 75 |
| | 4 | 15 |
| | 3 | 5 |
| S10 | 5 | 75 |
| | 4 | 15 |
| | 3 | 5 |
| S11 | 5 | 75 |
| | 4 | 15 |
| | 3 | 5 |
| ANY | 5 | 50 |
| S4, S5, S6 | 4 | 15 |
| | 3 | 5 |

SYMBOLS

| Symbol | Symbol Set 1 | Symbol Set 2 | Comments |
|---|---|---|---|
| W | Wild Logo | Wild Logo | |
| S2 | Blue Star | Silhouetted Couple | |
| S3 | Red 7 | Crown | |
| S4 | Triple Bar | Diamond Jewel | May be used in Any Bar/Jewel pays |
| S5 | Double Bar | Heart Jewel | May be used in Any Bar/Jewel pays |
| S6 | Single Bar | Oblong Jewel | May be used in Any Bar/Jewel pays |
| S7 | Bell | A | |
| S8 | Melon | K | |
| S9 | Plum | Q | |
| S10 | Orange | J | |
| S11 | Cherries | 10 | |
| T | Trigger | Trigger | |

In this preferred embodiment base slot game, the Base Game ER=0.8861 for non-max bet and the Base Game ER=0.8986 for max bet with recommended meter contributions. The Hit Frequency (i.e. percentage of winning game outcomes to total game outcomes)=56.2%. The Base Feature Frequency=4.45% or 1 in 22.5 games, the Bonus Frequency=1.74% or 1 in 57.5 games.

In one embodiment, an outcome of the base slot game is determined by a spin of the reels and the resulting set of symbols which are displayed thereby, in relation to the active pay lines. The reels may be spun or rotated (physically or virtually by video representation), in one or more directions (such as downward when the reels are arranged for rotation about a horizontal axis) to a stopping position in which the reels display symbols. That stopping position and the associated displayed symbols represent the outcome of the base game. As disclosed below, such a result may include the consideration of wild symbols and the like. In addition, while the outcome may be losing, be winning and have an associated award (such as of one or more credits), the outcome may also trigger one or more additional game features or bonus games/events.

Base Game Feature: "Sequential Nudges" or "Nudge-O-Matic"

In a preferred embodiment of the invention, the base slot game includes a nudge feature. In accordance with the nudge feature, the position of one or more of the reels are changed, thus potentially changing the combination of resulting displayed symbols, as detailed below.

In one embodiment, the nudge feature is activated or implemented upon a certain trigger. While the trigger could be random, in a preferred embodiment, the trigger comprises the receipt of 2 or more scattered trigger symbols aligning within the base game.

As a first aspect of the nudge feature, all reels containing a trigger are preferably "locked" (i.e. prevented from further movement). This effect may be indicated to a player, such as by highlighting a border around each locked reel and/or providing an associated sound effect.

Next, the triggers animate to become Wild. Once this sequence has taken place, the initial base game win is evaluated by comparing the outcome of the slot symbols to the pay table.

Thereafter, the nudging component of the feature takes place. Beginning with the leftmost unlocked reel, each unlocked reel nudges 3 reel stops or positions downward in the same direction as the reel spin. In the event any new trigger symbols are displayed as a result of the reel movement, those symbols are animated to become Wild, with the associated reel then locked into place. The game, in turn, nudges each unlocked reel until the rightmost reel is nudged. Then, beginning with the rightmost unlocked reel, the process is repeated traveling right-to-left among the reels. After each reel nudging, the resulting combination of symbols is preferably again re-evaluated for potential winning outcomes or combinations.

The nudge feature of the invention has two primary advantages to the player. First, the player continues to accumulate winnings during the nudging sequence. And second, the player may nudge additional trigger symbols into position leading to a bonus game (if triggering the feature with 2 triggers, trying to get a 3rd trigger), or enhanced bonus game play (if triggering the feature with 3 or more triggers, trying to make the ensuing bonus game worth more).

EXAMPLE 1

By way of example, utilizing the pay table shown above but utilizing a separate set of reel strips, depicting W for wild symbols, S2 through S11 for non-wild symbols and S14 for the triggers, a wager of 5 credits per line, we consider the following base game spin outcome.

| Reel 1 | Reel 2 | Reel 3 | Reel 4 | Reel 5 |
|---|---|---|---|---|
| S8 | S9 | S7 | S10 | S8 |
| S7 | S14 | S6 | S14 | S3 |
| S11 | S7 | S3 | S11 | S10 |

Figure 2A:
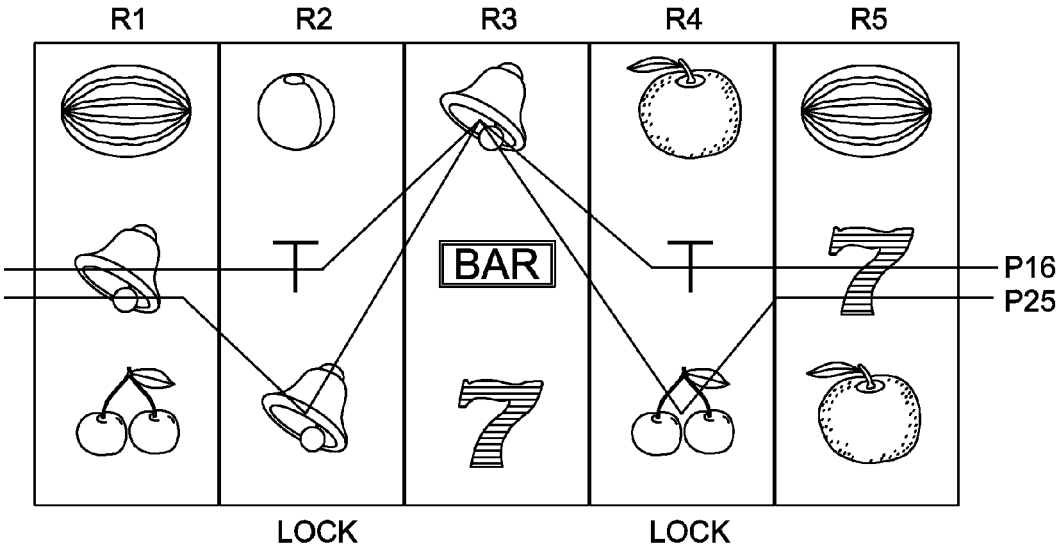
FIG. 2A illustrates one example reel spin outcome in accordance with an example of the game of the invention.

As illustrated in FIG. 2A, as a result of the initial spin, triggers or trigger symbols (S14 herein) appear on reels 2 and 5. As such, these two S14 symbols become wild for the feature, and reels 2 and 5 are locked to initiate the feature. Wins are then evaluated, yielding a win of 100credits for 4 S7 symbols on pay line 16 and a win of 25 credits for 3 S7 symbols on pay line 25. It is noted that because trigger symbols S14 became wild, the player received an extra win, in the case of the 4 S7 symbols (which outcome would otherwise not have been received).

Thereafter, reel 1 is nudged first. The nudging is accomplished in the following manner—assuming the original reel stop positions were, for example, 17, 18, 19 (for the bottom, mid and top symbol appearing on the display), the reel would be nudged to reveal the next 3 reel stop positions 20, 21, 22 (for the bottom, mid and top symbol appearing on the display).

| Reel 1 | Reel 2 Locked | Reel 3 | Reel 4 Locked | Reel 5 |
|---|---|---|---|---|
| S3 | S9 | S7 | S10 | S8 |
| S7 | S14 | S6 | S14 | S3 |
| S9 | S7 | S3 | S11 | S10 |

Figure 2B:
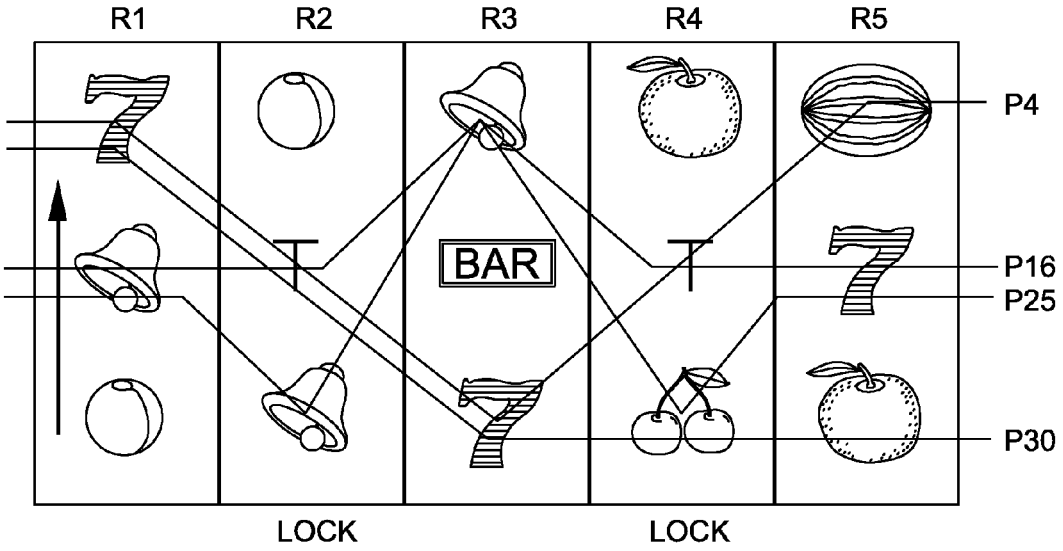

If reel 1 had nudged one or more additional triggers onto the display, then these in turn would become wild and the reel would lock. In this case, no triggers were additionally displayed. Therefore, wins are evaluated. In this case, as illustrated in FIG. 2B, the result of the nudging of reel 1 resulted in a win of 375 credits for 4 S3 symbols on pay line 4, a win of 100 credits for 4 S7 symbols on pay line 16, a win of 25 credits for 3 S7 symbols on pay line 25 and a win of 125credits for 3 S3 symbols on pay line 30.

Next, reel 3 is nudged 3 reel stop positions.

| Reel 1 | Reel 2 Locked | Reel 3 | Reel 4 Locked | Reel 5 |
|---|---|---|---|---|
| S3 | S9 | S10 | S10 | S8 |
| S7 | S14 | W | S14 | S3 |
| S9 | S7 | S11 | S11 | S10 |

As a result of the nudging of reel 3, the player has received a win of 100 credits for 4 S7 symbols on pay line 1, 25 credits for 3 S7 symbols on pay line 9, 25 credits for 3 S7 symbols on pay line 15, 375 credits for 4 S3 symbols on pay line 20, 75 credits for 4 S9 symbols on pay line 21 and 25 credits for 3 S9 symbols on pay line 27.

Next, reel 5 is nudged 3 positions.

| Reel 1 | Reel 2 Locked | Reel 3 | Reel 4 Locked | Reel 5 |
|---|---|---|---|---|
| S3 | S9 | S10 | S10 | S5 |
| S7 | S14 | W | S14 | S9 |
| S9 | S7 | S11 | S11 | S2 |

As a result of the nudging of reel 5, the player has received a win of 100 credits for 4 S7 symbols on pay line 1, 25 credits for 3 S7 symbols on pay line 9, 25 credits for 3 S7 symbols on pay line 15, 375 credits for 4 S3 symbols on pay line 20, 75 credits for 4 S9 symbols on pay line 21 and 25 credits for 3 S9 symbols on pay line 27.

Since the left-to-right has been completed, the nudging now continues right-to-left. To wit, reel 5 is again nudged 3 positions.

| Reel 1 | Reel 2 Locked | Reel 3 | Reel 4 Locked | Reel 5 |
|---|---|---|---|---|
| S3 | S9 | S10 | S10 | S7 |
| S7 | S14 | W | S14 | S4 |
| S9 | S7 | S11 | S11 | S10 |

As a result of the re-nudging of reel 5, the player has received a win of 100 credits for 4 S7 symbols on pay line 1, 25 credits for 3 S7 symbols on pay line 9, 25 credits for 3 S7 symbols on pay line 15, 375 credits for 4 S3 symbols on pay line 20, 75 credits for 4 S9 symbols on pay line 21 and 25 credits for 3 S9 symbols on pay line 27.

Next, reel 3 is nudged 3 positions.

| Reel 1 | Reel 2 Locked | Reel 3 | Reel 4 Locked | Reel 5 |
|---|---|---|---|---|
| S3 | S9 | S10 | S10 | S7 |
| S7 | S14 | S11 | S14 | S4 |
| S9 | S7 | S4 | S11 | S10 |

There is no resulting win as a result of the re-nudging of reel 3

Finally, reel 1 is nudged 3 positions leading to the final outcome.

| Reel 1 | Reel 2 Locked | Reel 3 | Reel 4 Locked | Reel 5 |
|---|---|---|---|---|
| S7 | S9 | S10 | S10 | S7 |
| S2 | S14 | S11 | S14 | S4 |
| S6 | S7 | S4 | S11 | S10 |

As a result of the re-nudging of reel 1, the player has received a win of 500 credits for 4 S2 symbols on pay line 1 and 75 credits for 4 "Any S4, S5, S6" symbols on pay line 13. The player has thus won a total of 3,200 credits for the play of the base game with the nudge feature. Note that in this case, the feature resulted in a win for the player but did not result in displaying a 3rd trigger that would have launched the bonus game.

EXAMPLE 2

The initial base game reel spin result is as follows:

| Reel 1 | Reel 2 | Reel 3 | Reel 4 | Reel 5 |
|---|---|---|---|---|
| S9 | S14 | S7 | S10 | S7 |
| S10 | S9 | S6 | S9 | S8 |
| S11 | S14 | S11 | S8 | W |

As indicated, the two S14 trigger symbols appearing on reel 2 initiate the base game nudge feature. Those symbols become wild, reel 2 is locked, and the outcome of the reels and associated pays are initially evaluated. In this case, the player received wins of 25 credits for 3 S11 symbols on pay line 3 and 3 S11 symbols on pay line 19.

Thereafter, reel 1 is nudged 3 stop positions, with the following result.

| Reel 1 | Reel 2 Locked | Reel 3 | Reel 4 | Reel 5 |
|---|---|---|---|---|
| S14 | S14 | S7 | S10 | S7 |
| S11 | S9 | S6 | S9 | S8 |
| S3 | S14 | S11 | S8 | W |

In this case, the nudging of reel 1 resulted in the display of an additional trigger symbol and therefore the S14 symbol on reel 1 becomes wild and reel 1 is locked. Pays are then evaluated, with the player receiving wins of 25 credits for 3 S7 symbols on pay line 2, 50 credits for 3 S6 symbols on pay line 6, 25 credits for 3 511 symbols on pay line 11, 25 credits for 3 S7 symbols on pay line 18, 25 credits for 3 S11 symbols on pay line 22, 25 credits for 3 S11 symbols on pay line 24, 50 credits for 3 S6 symbols on pay line 26, and 25 credits for 3 S11 symbols on pay line 28.

Next, reel 3 is nudged 3 positions.

| Reel 1 Locked | Reel 2 Locked | Reel 3 | Reel 4 | Reel 5 |
|---|---|---|---|---|
| S14 | S14 | S9 | S10 | S7 |
| S11 | S9 | S5 | S9 | S8 |
| S3 | S14 | S8 | S8 | W |

As a result of the nudging of reel 3, the player has received wins of 25 credits for 3 S9 symbols on pay line 2, 75 credits for 3 S5 symbols on pay line 6, 75 credits for 4 S9 symbols on pay line 12, 25 credits for 3 S9 symbols on pay line 18, 25 credits for 3 S8 symbols on pay line 22, 75 credits for 3 S5 symbols on pay line 26, and 100 credits for 4 S8 symbols on pay line 28.

Next, reel 4 is nudged 3 positions.

| Reel 1 Locked | Reel 2 Locked | Reel 3 | Reel 4 | Reel 5 |
|---|---|---|---|---|
| S14 | S14 | S9 | S10 | S7 |
| S11 | S9 | S5 | S4 | S8 |
| S3 | S14 | S8 | S11 | W |

As a result of the nudging of reel 4, the player has received wins of 25 credits for 3 S9 symbols on pay line 2, 75 credits for 3 S5 symbols on pay line 6, 25 credits for 3 S9 symbols on pay line 12, 25 credits for 3 S9 symbols on pay line 18, 25 credits for 3 S8 symbols on pay line 22, 75 credits for 3 S5 symbols on pay line 26 and 25 credits for 3 S8 symbols on pay line 28.

Next, reel 5 is nudged 3 positions.

| Reel 1 Locked | Reel 2 Locked | Reel 3 | Reel 4 | Reel 5 |
|---|---|---|---|---|
| S14 | S14 | S9 | S10 | S6 |
| S11 | S9 | S5 | S4 | S11 |
| S3 | S14 | S8 | S11 | S4 |

As a result of the nudging of reel 5, the player has received wins of 25 credits for 3 S9 symbols on pay line 2, 75 credits for 3 S5 symbols on pay line 6, 25 credits for 3 S9 symbols on pay line 12, 25 credits for 3 S9 symbols on pay line 18, 25 credits for 3 S8 symbols on pay line 22, 75 credits for 3 S5 symbols on pay line 26 and 25 credits for 3 S8 symbols on pay line 28.

This completes the left-to-right nudging. Next, the reels are nudged right-to-left, beginning with reel 5 again being nudged 3 positions.

| Reel 1 Locked | Reel 2 Locked | Reel 3 | Reel 4 | Reel 5 |
|---|---|---|---|---|
| S14 | S14 | S9 | S10 | S7 |
| S11 | S9 | S5 | S4 | S14 |
| S3 | S14 | S8 | S11 | S8 |

As a result of the re-nudging of reel 5, another trigger symbol has been received, and this S14 symbol becomes wild and reel 5 is locked. Thereafter, pays are evaluated. The player has received wins of 25 credits for 3 S9 symbols on pay line 2, 75 credits for 3 S5 symbols on pay line 6, 25 credits for 3 S9 symbols on pay line 12, 25 credits for 3 S9 symbols on pay line 18, 25 credits for 3 S8 symbols on pay line 22, 75 credits for 3 S5 symbols on pay line 26 and 25 credits for 3 S8 symbols on pay line 28.

Reel 4 is next re-nudged 3 positions.

| Reel 1 Locked | Reel 2 Locked | Reel 3 | Reel 4 | Reel 5 Locked |
|---|---|---|---|---|
| S14 | S14 | S9 | S8 | S7 |
| S11 | S9 | S5 | S9 | S14 |
| S3 | S14 | S8 | S7 | S8 |

As a result of the re-nudging of reel 4, the player has received wins of 25 credits for 3 S9 symbols on pay line 2, 75 credits for 3 S5 symbols on pay line 6, 75 credits for 4 S9 symbols on pay line 12, 25 credits for 3 S9 symbols on pay line 18, 100 credits for 4 S8 symbols on pay line 22, 75 credits for 3 S5 symbols on pay line 26 and 25 credits for 3 S8 symbols on pay line 28.

Next, reel 3 is re-nudged 3 positions.

| Reel 1 Locked | Reel 2 Locked | Reel 3 | Reel 4 | Reel 5 Locked |
|---|---|---|---|---|
| S14 | S14 | S10 | S8 | S7 |
| S11 | S9 | S7 | S9 | S14 |
| S3 | S14 | S4 | S7 | S8 |

As a result of the re-nudging of reel 3, the player has received wins of 25 credits for 3 S10 symbols on pay line 2, 100 credits for 4 S7 symbols on pay line 6, 25 credits for 3 S 10 symbols on pay line 18, 100 credits for 3 S4 symbols on pay line 22, 500 credits for 5 S7 symbols on pay line 26 and 100 credits for 3 S4 symbols on pay line 28.

As reel 2 is already locked (from the original base game spin) and reel 1 is also locked (from the nudging feature), then there remain no additional reels to nudge. The player's total win up until this point is 2,775 credits.

While in a preferred embodiment of the invention the reels are nudged three positions, in other embodiments, the reels may be nudged in greater or fewer than 3 positions at a time. For example, in one embodiment, the reels may be nudged one symbol position at a time. In another embodiment, the number of positions that each reel is nudged may be random.

While in a preferred embodiment of the invention the reels are nudged in the same direction as they were originally rotated (wherein if the reels were originally rotated down, the reels are nudged downwardly as well), in other embodiments, the nudging may be performed in a direction opposite to the original direction of reel spin (such by nudging the reels upwardly when they were originally rotated downwardly). Alternatively, some reels might be nudged in the same direction as the original reel rotation and others might be rotated in the reverse direction.

In addition, while the reels are preferably nudged in sequence from left to right and then back right to left, the sequential order of nudging could begin right-to-left. In still another embodiment, the nudging need not reverse direction, such as by occurring left-to-right and the left-to-right again, or by re-nudging more than two sequences, such as left-to-right, then right-to-left and then left-to-right again. In another embodiment, the order of nudging the reels could be randomly determined.

While the preferred embodiment utilizes triggers to lock reels, in other embodiments the reels to be locked may be chosen by the player. Alternatively, non-trigger symbols or wild symbols may cause the reels to be locked. In one preferred embodiment, once a reel is locked, each symbol displayed on the locked reel becomes wild for the duration of the feature.

In one embodiment, only the originally locked reels are capable of being locked-in, and any additional trigger symbols that appear during the nudging do not lock their respective reels, which continue to nudge as prescribed. In this embodiment, it is preferred that the nudge is one symbol position at a time and each reel be limited to a number of nudges equal to the number of symbol positions displayed on the reel. This is so a trigger, once nudged onto a reel during the feature, will not later be nudged off during the feature.

As indicated above, in one preferred embodiment of the invention, if the player receives a minimum number of trigger symbols, a bonus game is triggered. In one embodiment, the bonus game is triggered if the player receives 3 or more triggers (in this example, 4 scattered triggers are now displayed). Such a bonus game is described in detail below.

Primary Bonus Game

As indicated herein, in a preferred embodiment of the invention, the game not only comprises a base game and, at one or more times, a base game feature, but at one or more times an additional primary bonus game or event. In one embodiment, the bonus game begins or initiates when it is triggered. In one embodiment, the trigger comprises the receipt of 3 or more trigger symbols on the base game.

In one embodiment, in accordance with the primary bonus game, the player is afforded a number of picks of the trigger symbols themselves, which symbols hide either entry to the Cash Drop Bonus, the "Having a Ball" Free Spins Bonus or a Numeric Award. Set forth below is one example an award table for the primary bonus event:

| | Trigger Awards | | | | |
|---|---|---|---|---|---|
| | 3 Triggers | 4 Triggers | 5 Triggers | 6 Triggers | 7 triggers |
| # of Picks | 1 | 2 | 3 | 6 | 7 |
| Trigger Awards | Cash Drop (Small Level) Having a Ball (8 free spins) 5 × Total Bet | Cash Drop (Med Level) Having a Ball (16 free spins) 5 × Total Bet 10 × Total Bet | Cash Drop (Large Level) Having a Ball (24 free spins) 5 × Total Bet 10 × Total Bet 15 × Total Bet | Cash Drop (Jumbo Level) Having a Ball (32 free spins) 5 × Total Bet 5 ×, 10 ×, or 15 × Total Bet 10 ×, 15 × or 20 × Total Bet 20 × Total Bet | Cash Drop (Super Level) Having a Ball (40 free spins) 10 × Total Bet 10 ×, 20 ×, or 30 × Total Bet 20 ×, 30 × or 40 × Total Bet 30 ×, 40 × or 50 × Total Bet 50 × Total Bet |

Preferably, the player is informed as to how many picks are awarded (such as by an on-screen notification). Each trigger symbol is randomly assigned one of the awards from the pay table above. Then the player is prompted to pick one of the trigger symbols and is awarded the associated attribute, in other words, the hidden numeric value or bonus game. If the pick represents the player's final pick, then the remaining unpicked trigger attributes are revealed.

If the associated award is a Numeric Award, the Win meter increments. If the associated award is the Cash Drop Bonus, then that bonus game initiates (as described below) and wins are accumulated to the Bonus Win meter. Upon return to the base game, the Bonus Win amount is credited to the base game Win meter. If the associated award is the "Having a Ball" Free Spins Bonus, then this bonus game initiates (as described below) and wins are accumulated to the Bonus Win meter. Upon return to the base game, the Bonus Win amount is credited to the base game Win meter.

Thereafter, upon completion of the player's first pick including crediting to the base game, subsequent picks (as applicable) take place in the same manner.

Cash Drop Bonus Game

As indicated above, one result of the primary bonus game may be the triggering of a secondary bonus game or event. One such secondary bonus game may comprise a cash drop bonus game.

In one embodiment, this secondary bonus game comprises a single pachinko or pachinko-style ball drop, such as in the top box associated with the gaming machine. Such a game may comprise the dropping of balls through a game board towards a number of designated lanes or positions.

If the player has wagered a maximum wager, then half of the lanes are might be associated with a progressive award (the level of which might correspond to the number of initiating triggers), and the remainder of the lanes might be associated with ½ of the progressive level reseed.

If the player has wagered a less than maximum wager, then half of the lanes might be associated with an award comprising the progressive reseed multiplied by actual wager divided by max wager, while the remainder of the lanes might be associated with an award comprising ½ of this value.

One example of such awards might be:

Progressive Parameters

| | Small | Med | Large | Jumbo | Super |
|---|---|---|---|---|---|
| Reseed ($) | $50.00 | $100.00 | $200.00 | $500.00 | $2,500.00 |
| Reseed (× max line bet) | 1,000× | 2,000× | 4,000× | 10,000× | 50,000× |
| Contribution | 0.20% | 0.20% | 0.30% | 0.30% | 0.25% |
| Ave Max-bet Jackpot* | $52.26 | $105.76 | $243.10 | $745.71 | $6,483.81 |
| Ave. Typical Jackpot ** | $54.52 | $111.53 | $286.21 | $991.42 | $10,467.62 |

*Assumes all of wagering handle is max bet.

** Assumes half of wagering handle is max bet.

In one embodiment, the pachinko game might comprise 10 lanes. The tables below summarize one embodiment of the 10 pachinko lane values for the Cash Drop bonus. In each case, 5 lanes are at the high value and 5 lanes are at the low value. Note that the high lane value is equal to the same line-bet multiplier as the progressive reseed. In the case of a max bet, the high lane value is the corresponding progressive level.

3 Trigger Cash Drop Pachinko Lane Values

| Wager | 5 lanes @ high | 5 lanes @ low |
|---|---|---|
| 50, 100, 150 or 200 credits (1-4 credits per line) | 1,000 × line bet | 500 × line bet |
| 250 credits (5 credits per line) | Small Progressive | 500 × line bet |

4 Trigger Cash Drop Pachinko Lane Values

| Wager | 5 lanes @ high | 5 lanes @ low |
|---|---|---|
| 50, 100, 150 or 200 credits (1-4 credits per line) | 2,000 × line bet | 1,000 × line bet |
| 250 credits (5 credits per line) | Med Progressive | 1,000 × line bet |

5 Trigger Cash Drop Pachinko Lane Values

| Wager | 5 lanes @ high | 5 lanes @ low |
|---|---|---|
| 50, 100, 150 or 200 credits (1-4 credits per line) | 4,000 × line bet | 2,000 × line bet |
| 250 credits (5 credits per line) | Large Progressive | 2,000 × line bet |

6 Trigger Cash Drop Pachinko Lane Values

| Wager | 5 lanes @ high | 5 lanes @ low |
|---|---|---|
| 50, 100, 150 or 200 credits (1-4 credits per line) | 10,000 × line bet | 5,000 × line bet |
| 250 credits (5 credits per line) | Jumbo Progressive | 5,000 × line bet |

7 Trigger Cash Drop Pachinko Lane Values

| Wager | 5 lanes @ high | 5 lanes @ low |
|---|---|---|
| 50, 100, 150 or 200 credits (1-4 credits per line) | 50,000 × line bet | 25,000 × line bet |
| 250 credits (5 credits per line) | Super Progressive | 25,000 × line bet |

In this manner, the pachinko game play is utilized as a method in order to potentially award a player a progressive prize. In particular, the player has a high (50%) probability of winning the progressive prize during the Cash Drop bonus. This is because 5 of the 10 pachinko lanes depict the progressive prize, and the progressive prize itself is awarded if the ball lands in one of the appropriate lanes. The choice of 5 levels of progressive, the reseed values and increment rate, are matters of design choice. If desired, greater or fewer than 5 lanes may award the progressive prize. For example, in one embodiment, only 1 lane depicts the progressive prize, making the player's chance 1 in 10 of winning the progressive on the pachinko ball drop.

"Having a Ball" Free Spins Bonus Game

As indicated above, another result of the primary bonus game may be the triggering of a secondary bonus game. Another such secondary bonus game may comprise a "Having a Ball" free spins bonus game.

In one embodiment, this secondary game may also comprise a pachinko or pachinko-style game. To begin, a set of lane values may be depicted on the top display, as follows, randomly assigned to the 10 lanes. To begin, 9 of the lanes are assigned numeric values, and 1 lane is assigned the value of ALL the numeric lanes.

| Initial Pachinko Lane Values<br>Initial Lane Values<br>(×line bet) |
|---|
| 50 |
| 50 |
| 50 |
| 75 |
| 75 |
| 100 |
| 100 |
| 125 |
| 150 |
| ALL |

Thereafter, a set of free spins utilizing bonus reels (which may be video or physical reels and may be part of the main gaming machine or a top box or the like) takes place, as follows.

Free Spins as a Function of Initiating Triggers

| Number of Initiating Triggers | Number of Free Spins |
|---|---|
| 3 | 8 |
| 4 | 16 |
| 5 | 24 |
| 6 | 32 |
| 7 | 40 |

During the free spins, depending on triggering, the pachinko lane values may be updated and/or pachinko balls may drop to give awards. Upon conclusion of the free spins, a final ball drop occurs. The bonus reels do not utilize the base game triggers, but instead utilize two types of unique triggers internal to the "Having a Ball" Free Spins Bonus round.

Internal Trigger 1: The first trigger type is an "Update Lane" trigger. Aligning the Update Lane trigger anywhere on the reels causes it to randomly reveal, with equal weighting, either 25×, 50×, 75×, 100×, 125× or 150× line bet, the value of which is added to a random numeric lane on the top display. For a given spin, it is possible to have multiple Update Lane triggers, and all of them are always applied to the top display. On-screen, the Update Lane trigger pops-off the reels as it reveals the update value, e.g., "Update Lane +500". Subsequently, a dynamic arrow orbits into the plane of the display and back out, settling behind the update value and hovering thereupon, instructing the player to "Look Up!". On the top display, a random numeric lane value then pulses rapidly and "explodes" revealing the updated new value in its place.

Internal Trigger 2: The second trigger type is a "Ball Drop" trigger. Aligning the Ball Drop trigger anywhere on the reels causes a ball to drop in the pachinko top box. On an associated display screen, in one embodiment a visual display may be provided to the player, such as by visually causing the Ball Drop trigger to pop-off the reel to become a round button center-screen, strobing and prompting via "Drop Ball!" the player to touch, whereupon the "Look Up!" arrow prompts the player to look-up for the ball drop. The associated lane award is credited to the Bonus Win meter.

Once all free spins have ended, the player is awarded one final ball drop to end the bonus game. The "Drop Ball!" animation may fade out on the main screen. The associated lane award is credited to the bonus Win meter. Thereafter, the closing screen summarizes the total win from the "Having a ball" Free Spins Bonus game and thanks the player for playing.

Set forth below is an example implementation of the "Having a Ball" Free Spins Bonus wherein: (1) All pays same as Base Game, left to right starting with leftmost reel; (2) Only highest winner paid per line Symbol 1 is Wild and substitutes for Symbols 2-11; and (3) the Reel Matrix ("Having a Ball" Free Spins) comprises:

| 75 | 73 | 73 | 72 | 66 | |
|---|---|---|---|---|---|
| 5 | 5 | 5 | 6 | 4 | !Wild |
| 4 | 4 | 4 | 3 | 4 | !Symbol 2 |
| 4 | 4 | 5 | 5 | 4 | !Symbol 3 |
| 5 | 6 | 5 | 4 | 2 | !Symbol 4 |
| 6 | 8 | 4 | 6 | 2 | !Symbol 5 |
| 5 | 8 | 4 | 6 | 2 | !Symbol 6 |
| 8 | 6 | 8 | 9 | 9 | !Symbol 7 |
| 8 | 7 | 8 | 9 | 9 | !Symbol 8 |
| 9 | 7 | 9 | 6 | 9 | !Symbol 9 |
| 9 | 7 | 9 | 6 | 9 | !Symbol 10 |
| 9 | 7 | 9 | 8 | 9 | !Symbol 11 |
| 2 | 3 | 2 | 3 | 2 | !Trigger 1-Lane Update |
| 1 | 1 | 1 | 1 | 1 | !Trigger 2-Ball Drop |

In one preferred embodiment, the Reel Strips for implementing the "Having a Ball" Free Spins bonus may have the following symbol arrangement:

Reel 1: S7 S9 S3 W S6 S2 S7 T2 S10 S6 S7 S5 S8 S4 S9 S11 S5 W S8 S7 S6 T S11 S4 S8 S7 S5 S9 S8 S4 S11 S5 S10 S9 S3 S11 T S10 S8 W S4 S10 S9 W S2 S10 S11 S5 S9 S10 S2 S11 S3 S7 S8 W S9 S10 S6 S11 S7 S8 S3 S5 S7 S2 S4 S6 S8 S10 S9 S11 S10 S9 S11

Reel 2: S10 S6 S2 W S10 S4 S7 S2 S5 S11 S6 W S8 S6 S11 T S3 S5 S10 S9 W S5 S4 S7 T S4 S2 S10 S11 S8 S5 S3 S6 T S11 S6 S3 S10 S4 S7 S2 S5 T2 S6 S7 S9 S8 S6 W S9 S5 S8 S4 S9 S11 W S5 S7 S9 S4 S8 S7 S10 S11 S8 S10 S9 S5 S11 S3 S6 S8 S9

Reel 3: S7 S8 S2 S9 W S6 S3 S11 S8 S7 S4 S9 S10 S8 S5 S11 S3 S9 S11 S8 S4 S10 S9 T S7 S8 S9 W S11 S5 S10 S11 S6 S7 S8 S10 S9 S4 W S7 S5 S11 S9 S10 S7 W S11 S8 S10 T S9 S3 S6 S7 T2 S11 S3 S10 S4 S2 S10 S6 S2 W S7 S5 S11 S10 S2 S8 S3 S9 S4

Reel 4: S4 S11 S7 S3 S6 W S7 S8 S6 S5 S8 S11 S9 S7 S11 W T S5 S8 S10 S5 S11 W S4 T2 S6 S7 S3 S10 T S8 S2 S11 W S4 S11 T S7 S3 S6 S7 S9 W S6 S5 S8 S11 S9 W S8 S7 S9 S6 S5 S8 S10 S5 S4 S10 S7 S3 S10 S8 S2 S9 S11 S2 S3 S7 S8 S9 S10

Reel 5: S9 S3 S2 S10 S8 S7 S9 S11 S10 S7 S8 S3 S7 S10 S9 S6 S8 S11 S5 W S8 S7 S4 T2 S11 S6 S8 T S7 S11 S9 S7 W S11 S10 S3 T S8 S2 W S9 S8 S10 S4 S7 S9 W S10 S11 S9 S10 S2 S11 S3 S5 S7 S2 S9 S10 S8 S11 S9 S7 S10 S8 S11

In one embodiment, this causes the bonus game statics to comprise: EV (8 Free Spins)=723.01; EV (16 Free Spins)=1407.18; EV (24 Free Spins)=2209.04; EV (32 Free Spins)=3130.53; EV (40 Free Spins)=4166.69.

One example of a "Having a Ball" free spins secondary bonus game will now be described. This example assumes a wager of 5 credits per pay line and 8 free spins, for example as may be awarded with 3 triggers from the base game. The initial lane values are as follows (all values already multiplied by line bet):

| Lane | | | | | | | | | |
|---|---|---|---|---|---|---|---|---|---|
| 1: | 2: | 3: | 4: | 5: | 6: | 7: | 8: | 9: | 10: |
| 250 | 500 | 375 | 625 | 250 | ALL | 750 | 500 | 250 | 375 |

First Spin:

| First Spin | | | | |
|---|---|---|---|---|
| Reel 1 | Reel 2 | Reel 3 | Reel 4 | Reel 5 |
| S11 | S9 | S10 | S8 | S10 |
| S2 | S7 | S3 | S5 | S2 |
| S10 | S5 | S11 | S6 | S3 |

The player wins nothing.

Second Spin:

| Second Spin | | | | |
|---|---|---|---|---|
| Reel 1 | Reel 2 | Reel 3 | Reel 4 | Reel 5 |
| W | S5 | S8 | S6 | S11 |
| S8 | W | S7 | T2 | S8 |
| S7 | S11 | T | S4 | S10 |

The player wins 25 credits for 3 S8 symbols on pay line 12, 25 credits for 3 S8 symbols on pay line 16, 25 credits for 3 S7 on pay line 20 and 25 credits for 3 S7 symbols on pay line 21. The update lane trigger (T) reveals 625 (corresponding to 125× line bet), randomly added to lane 1.

The new lane values are therefore:

| Lane | 1: | 2: | 3: | 4: | 5: | 6: | 7: | 8: | 9: | 10: |
|---|---|---|---|---|---|---|---|---|---|---|
| | 875 | 500 | 375 | 625 | 250 | ALL | 750 | 500 | 250 | 375 |

The ball drop trigger (T2) awards a ball drop. The ball lands in lane 1, and the player is awarded 875. The player's total bonus win so far is 975 credits.

Third Spin:

| Third Spin | | | | |
|---|---|---|---|---|
| Reel 1 | Reel 2 | Reel 3 | Reel 4 | Reel 5 |
| S10 | S10 | S10 | S11 | S8 |
| S5 | S2 | S8 | S8 | S9 |
| S11 | S4 | S7 | S5 | W |

The player wins 25 credits for 3 S10 symbols on pay line 2. The player's total bonus win is 1,000 credits.

Fourth Spin:

| Fourth Spin | | | | |
|---|---|---|---|---|
| Reel 1 | Reel 2 | Reel 3 | Reel 4 | Reel 5 |
| S7 | S11 | S7 | S10 | S11 |
| S2 | S10 | S6 | S4 | S9 |
| S6 | S7 | S11 | S5 | S7 |

The player wins 25 credits for 3 S7 symbols on pay line 18. The player's total bonus win is now 1,025.

Fifth Spin:

| Fifth Spin | | | | |
|---|---|---|---|---|
| Reel 1 | Reel 2 | Reel 3 | Reel 4 | Reel 5 |
| S11 | S9 | S8 | S7 | S9 |
| S9 | S8 | S11 | S10 | S10 |
| S10 | S6 | S3 | S4 | S7 |

The player wins nothing.

Sixth Spin:

| Sixth Spin | | | | |
|---|---|---|---|---|
| Reel 1 | Reel 2 | Reel 3 | Reel 4 | Reel 5 |
| S9 | S7 | S9 | S11 | S10 |
| S7 | S6 | S8 | S8 | S7 |
| S11 | T2 | S7 | S5 | S3 |

The player wins 25 credits for 3 S7 symbols on pay line 24. The player is also awarded a ball drop for the T2 trigger. The ball lands in lane 9, awarding the player 250. The player's total bonus win is now 1,300.

Seventh Spin:

| Seventh Spin | | | | |
|---|---|---|---|---|
| Reel 1 | Reel 2 | Reel 3 | Reel 4 | Reel 5 |
| S7 | W | T1 | S11 | S9 |
| S8 | S2 | S9 | S8 | S11 |
| W | S6 | S10 | S5 | S10 |

The player wins 25 credits for 3 S10 symbols on pay line 19 and 25 for 3 S9 on pay line 27, bringing the bonus win total to 1,350.

The random update lane value revealed is 625, randomly assigned to lane 9. The new lane values are therefore:

| Lane | | | | | | | | | |
|---|---|---|---|---|---|---|---|---|---|
| 1: | 2: | 3: | 4: | 5: | 6: | 7: | 8: | 9: | 10: |
| 875 | 500 | 375 | 625 | 250 | ALL | 750 | 500 | 875 | 375 |

Eighth Spin:

| Eighth Spin | | | | |
|---|---|---|---|---|
| Reel 1 | Reel 2 | Reel 3 | Reel 4 | Reel 5 |
| S2 | S8 | S8 | S11 | S11 |
| S6 | S11 | S7 | S8 | T2 |
| W | S10 | S6 | S5 | S4 |

The player wins 25 credits for 3 S8 symbols on pay line 29. The ball drop (for T2) lands in lane 10 awarding 375. The player's total bonus win is now 1,750 credits.

A final ball drop is now awarded, since all 8 spins have concluded. The ball lands in lane 2 awarding 500 credits. The player's final total bonus win is therefore 2,250 credits.

Note that in the preferred embodiment, the ALL lane awards the sum of all the numeric values. However, more than one ALL lane, or no ALL lanes may be utilized under the teachings herein.

Furthermore, fewer or more than eight free spins may be utilized. Indeed, a third type of trigger, capable of retriggering or extending the number of free spins, may also be utilized. Alternatively, once the 8 free spins have ended, the player may choose from among objects, at least one of which may award additional free spins. Or, the player may be given a pachinko ball drop wherein one or more lanes may award additional free spins. This pachinko ball drop may be in addition to the final ball drop described earlier, instead of the final ball drop, or the final ball drop may include one or more lanes that award additional free spins.

It will be appreciated that the game comprising a base game with a nudge feature might actually be implemented as a bonus game or event to another game. It will also appreciate that the game of the invention might be presented with other primary and/or secondary bonus games or events other than those described herein.

What has been described is a novel method of utilizing a combination of a sequential reel-nudging functionality, a transformation of a subset of symbols (such as trigger symbols) to become wild and a locking of a subset of reels, in order to create an extended, exciting casino gaming feature that may itself serve as a catalyst to additional bonus game play.

It is an advantage of the invention that the subset of symbols that become wild later reassume their original status upon conclusion of the feature so (e.g., the trigger symbols act as triggers, then convert to wild symbols for the nudge feature portion of the same, then regain "trigger" status and may trigger a bonus game) as to potentially trigger additional (e.g., bonus) game play.

It is also an advantage of the invention that the number of locking reels (containing wilds) may incrementally increase during the course of play (so that a nudged reel, if aligning a trigger symbol, locks-in and does not nudge again).

It is a further advantage of the instant invention that a player may, in qualifying only for a base game feature (e.g., with 2 triggers), through the sequential play of the feature, win base game awards but also qualify for a bonus game (e.g., with 3+ triggers), especially one that may win a progressive prize.

It is yet another advantage of the instant invention that a player may, in qualifying both for a base game feature and bonus game (e.g., with 3 triggers), through the sequential play of the feature, win base game awards but also qualify for a bonus game with greater expected value (e.g., with 4 triggers), especially one that may win a progressive prize.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A method of playing a game at a gaming machine having at least one video display, at least one player input device and a controller configured to execute machine-readable code to cause said gaming machine to implement the steps of:

accepting a wager from a player;

spinning a plurality of reels displayed on said at least one video display, each reel having a plurality of symbols associated therewith, said plurality of symbols including one or more non-wild nudge triggering symbols;

stopping said plurality of reels to cause each of said reels to display one or more base symbols, said reels collectively displaying a base set of symbols by said at least one video display;

evaluating an outcome of said game with reference to said base set of symbols;

determining if said base set of symbols includes a triggering condition comprising at least one non-wild nudge triggering symbol on each of at least two of said plurality of reels;

if said triggering condition has not occurred, awarding winnings for winning outcomes relative to said base set of symbols; and if said triggering condition has occurred:

(a) locking each of said reels which displays at least one of said non-wild nudge triggering symbols so that said one or more locked reels continue to display said base symbols during a remainder of the game;

(b) converting each non-wild nudge triggering symbol in said base set of symbols to a wild symbol;

(c) evaluating an outcome of said game with reference to said base symbols including any wild symbols and awarding winnings for any winning outcomes;

(d) nudging one of said plurality of reels that is not locked to a new position which causes said nudged reel to display one or more new symbols which, in combination with said base symbols, including any wild symbols, displayed by said one or more locked reels, causes said plurality of reels to display a modified set of symbols;

(e) if said one or more new symbols comprises a non-wild nudge triggering symbol, locking said nudged reel and converting said non-wild nudge triggering symbol to a wild symbol;

(f) evaluating an outcome of said game with reference to said modified set of symbols, including any wild symbols;

(g) awarding winnings for winning outcomes relative to said modified set of symbols; and (h) repeating steps (d) - (g) until at least each reel which is not locked is nudged at least one time.

2. The method in accordance with claim 1 further comprising the step of determining if a bonus game initiating trigger has occurred and, if so, presenting at least one bonus game offering an opportunity for the award of one or more bonus game winnings

3. The method in accordance with claim 2 further comprising initiating a secondary bonus game in the event a secondary bonus game initiating event is received as a result of said bonus game.

4. The method in accordance with claim 1 wherein said reels are arranged in columns from left to right and said step of nudging comprise nudging said reels that are not locked in sequence from left to right.

5. The method in accordance with claim 4 further comprising the steps of continuing said nudging of said reels that are not locked in sequence from right back to left.

6. The method in accordance with claim 1 wherein each reels each display three vertically arranged symbols and said nudging comprises changing a position of said reel by three positions.

7. The method in accordance with claim 6 wherein said step of spinning comprises rotating each reel downwardly and said step of nudging comprises rotating said reel downwardly by said three positions.

8. The method in accordance with claim 1 wherein said non-wild nudge triggering symbols have a first appearance and said step of converting each non-wild nudge triggering symbol comprises displaying a wild symbol having a second appearance different from said first appearance.

9. The method in accordance with claim 1 wherein said step of converting comprises animating each non-wild nudge triggering symbol into a wild symbol on said at least one video display.

10. A gaming machine comprising:

a housing;

at least one user input;

at least one electronic video display configured to display game information to a player;

at least one data storage device;

a controller configured to receive information from said at least one user input and to display game information via said at least one electronic video display to said player; and instructions stored on the at least one data storage device and executable by said controller to present a game, the one or more instructions comprising:

instructions for presenting a base video slot game in which a plurality of spinning reels are displayed on said at least one electronic video display and stopped to display a base set of symbols comprising one or more base symbols displayed by each of said plurality of reels;

instructions for determining if said base set of symbols includes a triggering condition comprising at least one non-wild nudge triggering symbol on each of at least two of said plurality of reels;

instructions for awarding winnings for winning outcomes relative to said base set of symbols if said triggering condition has not occurred; and instructions for initiating a nudge feature if said triggering condition has occurred, said nudge feature comprising:

(a) instructions for locking each of said reels which displays at least one of said non-wild nudge triggering symbols so that said one or more locked reels continue to display said base symbols during a remainder of the game;

(b) instructions for converting each non-wild nudge triggering symbol in said base set of symbols to a wild symbol;

(c) instructions for evaluating an outcome of said game with reference to said base symbols including any wild symbols and awarding winnings for any winning outcomes;

(d) instructions for displaying a modified set of symbols as a result of a displayed nudging movement of one of said plurality of reels that is not locked to a new position, said modified set of symbols comprising one or more new symbols displayed by nudged reel in combination with the one or more base symbols, including any wild symbols, displayed by said one or more locked reels;

(e) instructions for, if said one or more new symbols comprises a non-wild nudge triggering symbol, locking said nudged reel and converting any non-wild nudge triggering symbol to a wild symbol (f) instructions for evaluating an outcome of said game with reference to said modified set of symbols; and (g) instructions for awarding winnings for winning outcomes relative to said modified set of symbols; and (h) instructions for repeating steps (d)- (g) until at least each reel which is not locked is nudged at least one time.

11. The gaming machine in accordance with claim 10 further comprising instructions for determining if a bonus game initiating trigger has occurred and, if so, presenting at least one bonus game offering an opportunity for the award of one or more bonus game winnings.

12. The gaming machine in accordance with claim 11 further comprising instructions for initiating a secondary bonus game in the event a secondary bonus game initiating event is received as a result of said bonus game.

13. the gaming machine in accordance with claim 10 wherein said video reels are arranged in columns from left to right and said reels that are not locked are nudged in sequence from left to right.

14. The gaming machine in accordance with claim 10 wherein each video reel displays three vertically arranged symbols and said nudging comprises changing a displayed position of said reel by three positions.

15. The gaming machine in accordance with claim 10 wherein said non-wild nudge triggering symbols have a first appearance and said instructions for converting each non-wild nudge triggering symbol are configured to display a wild symbol having a second appearance different from said first appearance.

16. The gaming machine in accordance with claim 10 wherein said instructions for converting are configured to animate each non-wild nudge triggering symbol into a wild symbol on said at least one electronic video display.

* * * * *